US010557306B1

(12) United States Patent
Barley

(10) Patent No.: US 10,557,306 B1
(45) Date of Patent: Feb. 11, 2020

(54) SAFETY POOL LADDER

(71) Applicant: Roddrick Barley, Rochester, NY (US)

(72) Inventor: Roddrick Barley, Rochester, NY (US)

( * ) Notice: Subject to any disclaimer, the term of this patent is extended or adjusted under 35 U.S.C. 154(b) by 0 days.

(21) Appl. No.: 16/280,119

(22) Filed: Feb. 20, 2019

(51) Int. Cl.
*E06C 7/18* (2006.01)
*E06C 7/00* (2006.01)
*E06C 1/08* (2006.01)
*E04H 4/14* (2006.01)

(52) U.S. Cl.
CPC ..... *E06C 7/006* (2013.01); *E04H 4/144* (2013.01); *E06C 1/08* (2013.01)

(58) Field of Classification Search
CPC ..... E06C 1/39; E06C 1/08; E06C 1/12; E06C 7/006; E04H 4/144; E04H 4/06; A63G 21/00
See application file for complete search history.

(56) References Cited

U.S. PATENT DOCUMENTS 579,328 A * 3/1897 McConnell ..... E06C 1/005 182/28
1,229,698 A * 6/1917 Arbess ..... E06C 1/005 182/30
1,357,465 A * 11/1920 Mayer ..... A63G 21/00 472/116
1,545,240 A * 7/1925 Edwards ..... A63G 11/00 472/4
3,225,863 A * 12/1965 Ludlow ..... E06C 7/006 182/104
3,311,195 A * 3/1967 Singer ..... E06C 1/18 182/230
3,428,146 A * 2/1969 Bair ..... E04H 4/144 182/118
3,447,633 A * 6/1969 Montalto ..... E04H 4/144 182/118
3,991,851 A * 11/1976 Gannon ..... E04H 4/144 182/86
4,126,206 A * 11/1978 Becnel ..... E06C 7/006 182/106
4,181,195 A * 1/1980 Clarke ..... E06C 7/006 182/106
4,284,171 A * 8/1981 Owen ..... E04G 1/30 182/119
4,450,937 A * 5/1984 Broughton ..... E06C 1/16 182/106
4,579,197 A * 4/1986 Spurling ..... E06C 7/006 182/106

(Continued)

*Primary Examiner* — Colleen M Chavchavadze
(74) *Attorney, Agent, or Firm* — Sanchelima & Associates, P.A.; Christian Sanchelima; Jesus Sanchelima

(57) ABSTRACT

The present invention is a safety pool ladder to be installed against a wall of an above-ground pool. The safety pool ladder comprises a ladder structure comprising a plurality of step members extending horizontally between a pair of side members, and a flat surface disposed towards back of the plurality of step members, when the safety pool ladder is disposed in a use position. The safety pool ladder also comprises a pair of side rails with channels formed therein to allow the ladder structure to travel along a length thereof. The ladder structure is adapted to travel along the length of the side rails, and rotated and flipped thereafter such that the flat surface is disposed towards front of the plurality of step members to dispose the safety pool ladder in a block position.

5 Claims, 4 Drawing Sheets

(56) References Cited

U.S. PATENT DOCUMENTS 4,630,819 A * 12/1986 Levin ..... A63B 9/00 182/118
4,805,736 A * 2/1989 Byrnes, Jr. ..... E04H 4/144 182/156
5,332,062 A * 7/1994 Revere ..... E04G 1/34 182/118
5,626,205 A * 5/1997 Martin ..... B25H 1/005 182/153
5,641,035 A * 6/1997 Pettit ..... E04H 4/0018 182/118
6,543,579 B2 * 4/2003 Laug ..... E04G 1/30 182/115
6,769,513 B2 * 8/2004 Pettit ..... E04H 4/144 182/106
6,880,674 B1 * 4/2005 St-Hilaire ..... E04H 4/144 182/106
8,186,480 B1 * 5/2012 Yoakum, Jr. ..... E06C 1/39 182/118
8,191,681 B2 * 6/2012 Lipniarski ..... E06C 7/006 182/106
8,191,682 B2 6/2012 Lipniarski
8,381,873 B2 * 2/2013 Cross ..... E06C 1/39 182/119
8,505,687 B2 * 8/2013 Allam ..... E06C 7/006 182/106
8,720,644 B2 * 5/2014 Naranjo ..... E06C 7/006 182/106
9,169,066 B2 * 10/2015 Morikawa ..... B65G 1/02
9,320,955 B2 * 4/2016 Aral Diaz ..... A63B 17/00
9,404,305 B1 * 8/2016 Messick ..... E06C 7/16
10,113,361 B2 * 10/2018 Cheng ..... E06C 7/006
10,214,962 B2 * 2/2019 Lin ..... E06C 7/006
10,350,502 B2 * 7/2019 Nelson ..... A63G 31/14
2009/0095567 A1 * 4/2009 Rinna ..... E04G 1/30 182/124
2009/0133959 A1 * 5/2009 Eriksson ..... E04G 1/34 182/118
2015/0027810 A1 * 1/2015 Yoo ..... E06C 1/393 182/27
2015/0267469 A1 * 9/2015 Markusen ..... E06C 1/16 182/21
2017/0101821 A1 * 4/2017 Shattuck ..... E06C 7/006
2017/0260811 A1 * 9/2017 Trudeau ..... E06C 1/26
2018/0127997 A1 * 5/2018 Hsu ..... E04H 4/06

* cited by examiner

SAFETY POOL LADDER

BACKGROUND OF THE INVENTION

1. Field of the Invention

The present disclosure generally relates to pool ladders and, more particularly, to safety pool ladders to be used with above-ground swimming pools for restricting access thereto when required.

2. Description of the Related Art

An above-ground pool generally requires a ladder to facilitate ingress into the pool and egress from the pool. Such ladder includes steps to enable one to climb up over the side and into the pool. The above-ground pools are inherently safer as compared to in-ground pool because of their higher entry point, usually a minimal of 52" to 54" above the ground. The higher entry point means a lower risk of accidental falls, especially for children. However, when the pool is left unattended for longer periods of time, such as, for example, when the family is away on vacation, some mischievous children desiring to use the pool may climb up the ladder without adult supervision, which encourages unauthorized use of the swimming pool, and may even result in tragic and sometimes fatal accidents.

Some safety ladders for above-the-ground swimming pools have been known in the prior art which tries to restrict and prevent unauthorized access to the pool by small children. For example, some known pool ladders are detachably connected to wall of the above-ground pool, such that the ladder can be detached from the pool when not be used for extended period. By moving the pool ladder away from the pool, ingress into the pool may be restricted. Such an arrangement has been found to be satisfactory when the pool is left unattended by an adult for a short period of time. However, it has been found that often children discover innumerable alternate methods for reaching the pool by moving the pool ladder back to be disposed with the pool.

For instance, U.S. Pat. No. 8,191,682B2 discloses an A-frame ladder which has a first ladder and a second ladder. The first ladder has two rails interconnected by a plurality of steps and a first set of grooves that receive a gate/barrier device to inhibit a person from using the first ladder's steps. The second ladder also has two rails interconnected by a plurality of steps and a second set of grooves, interconnected to the first set of grooves, that receive the gate/barrier device so the first ladder and the second ladder can be used and inhibits a person from entering the area between the first ladder and the second ladder through the second ladder's steps. However, such gate can easily be jumped by a child with sufficient height, and thus could not ensure safety.

US Patent Publication No. 20170260811A1 (hereinafter referred to as '811 publication) discloses an automatic safety pool ladder for an above-ground swimming pool composed of a set of rotative self-closing steps where the retracted position prevents access to water and where access to open steps is easily controlled by user through a lever arm and positioned so that the arm is not accessible to children. However, in case of the '811 publications, the children can generally quickly figure out ways to pivot the steps back into use position such as by applying force onto the steps itself instead of on the lever, accessing the lever, or the like, which defeats the ultimate purpose of providing safety.

Therefore, there is a need to provide a safety pool ladder which can provide a simple and expeditious means for rendering the pool absolutely safe, insofar as small children are concerned. Documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a safety pool ladder which can be moved between a use position to allow ingress into a pool and a block position to restrict ingress into the pool.

It is another objective of the present invention to provide a safety pool ladder which can be conveniently moved between the use position and the block position and vice-versa, while still being fool-proof against children.

It is still another objective of the present invention to provide a safety pool ladder which is aesthetically pleasing, affordable, durable, easy to install and further easy to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
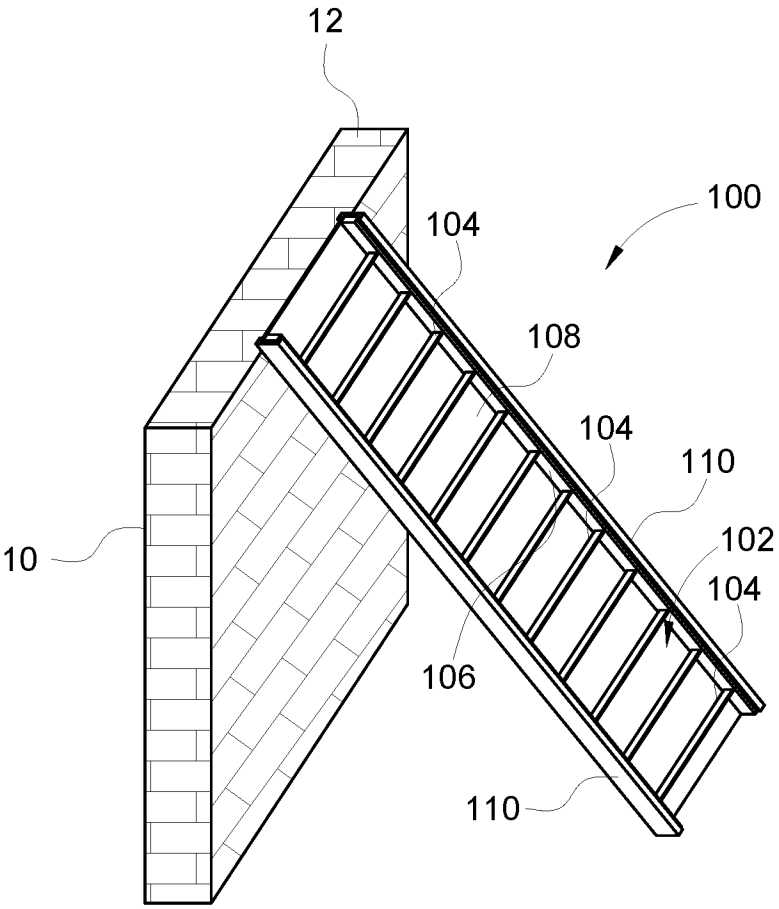
FIG. 1 illustrates a diagrammatic perspective view of a safety pool ladder 100 disposed against an above-ground pool 10 in a use position, in accordance with one or more embodiments of the present invention.

Referring to the drawings, FIG. 1 illustrates a diagrammatic view of a safety pool ladder (referred by the numeral 100), in accordance with an embodiment of the present invention. In the illustration of FIG. 1, the safety pool ladder 100 is shown to be installed against a wall 10. Herein, the wall 10 may be a wall of an above-ground pool (also, generally, referred by the numeral 10). The wall 10 is extending upwardly above ground, and supported on a pool peripheral ground extending substantially adjacently around the wall 10. Although, the present disclosure has been described in terms of the safety pool ladder 100 being implemented for safely accessing and providing restrictive access to the above-ground pool, such as the pool 10; in other examples, the present safety pool ladder 100 can be implemented for other purposes such as for providing restrictive access to a terrace, a tree-house, or the like without any limitations.

The safety pool ladder 100 includes a ladder structure 102. The ladder structure 102 includes a plurality of step members 104 extending horizontally between a pair of side members 106. As illustrated in FIG. 1, the plurality of step members 104 are transversally extending between the pair of side members 106. The step members 104 are disposed in an equidistantly spaced apart relationship along a length of the pair of side members 106. The ladder structure 102 may have a length extending from a top 12 of the wall 10 to the pool peripheral ground. That is, the ladder structure 102 is sufficiently sized and shaped for substantially stably standing over the wall 10, with a lower end of the ladder structure 102 resting on and engaging with the pool peripheral ground. In some examples, the ladder structure 102 may also include a pair of hand rails (not shown) which may be attached to and extending upwardly from the pair of side members 106 to provide support to the user climbing to the top 12 of the wall 10 employing the ladder structure 102. It may be contemplated that the present ladder structure 102 is generally similar in design to regular ladders as known in the art with the objective of supporting a user to climb upwards to the top 12 of the wall 10 by reaching and stepping one-by-one onto the step members 104 thereof. In one or more examples, the ladder structure 102 is preferably made from a rust resistant material, such as anodized aluminum, and are preferably of lightweight and inexpensive tubular construction.

In one or more embodiments of the present disclosure, the ladder structure 102 may have a flat surface 108 therein. The flat surface 108 may be in the form of a planar sheet extending between the pair of side members 106. As may be seen from FIG. 1, the flat surface 108 may be arranged towards the back of the plurality of step members 104, when the ladder structure 102 is disposed in the use position of FIG. 1, such that the step members 104 are disposed towards front for a user to climb onto thereof. In some examples, the step members 104 may be bolted onto the shown face of the flat surface 108 in FIG. 1. Further, illustrated in FIG. 4, the opposing face of the flat surface 108 may have no steps or rungs or any means to be used for climbing thereon. Herein, the flat surface 108 may be made of strong yet light material, such as sheet of aluminum or the like.

The safety pool ladder 100 of the present disclosure further comprises a pair of substantially parallel and generally identical side rails 110. Similar to the ladder structure 102, the side rails 110 are preferably made from a rust resistant material, such as anodized aluminum, and are preferably of lightweight and inexpensive tubular construction. Furthermore, the side rails 110 may be of single piece construction or may be of two-piece construction comprising two substantially straight sections or members which may or may not be fastened together by bolts, screws, or any other suitable conventional fastening means. Each of the side rails 110 may provide a channel 112 formed along the length thereof, and the ladder structure 102 is supported between the two channels 112 of the two side rails 110. In one or more examples, the side rails 110, or specifically the channels 112 thereof, may have a cross-sectional shape of an inverted "V" or "U". It may be appreciated that the side rails 110 may generally have same length as the length of the ladder structure 102 for providing support thereto.

Figure 2:
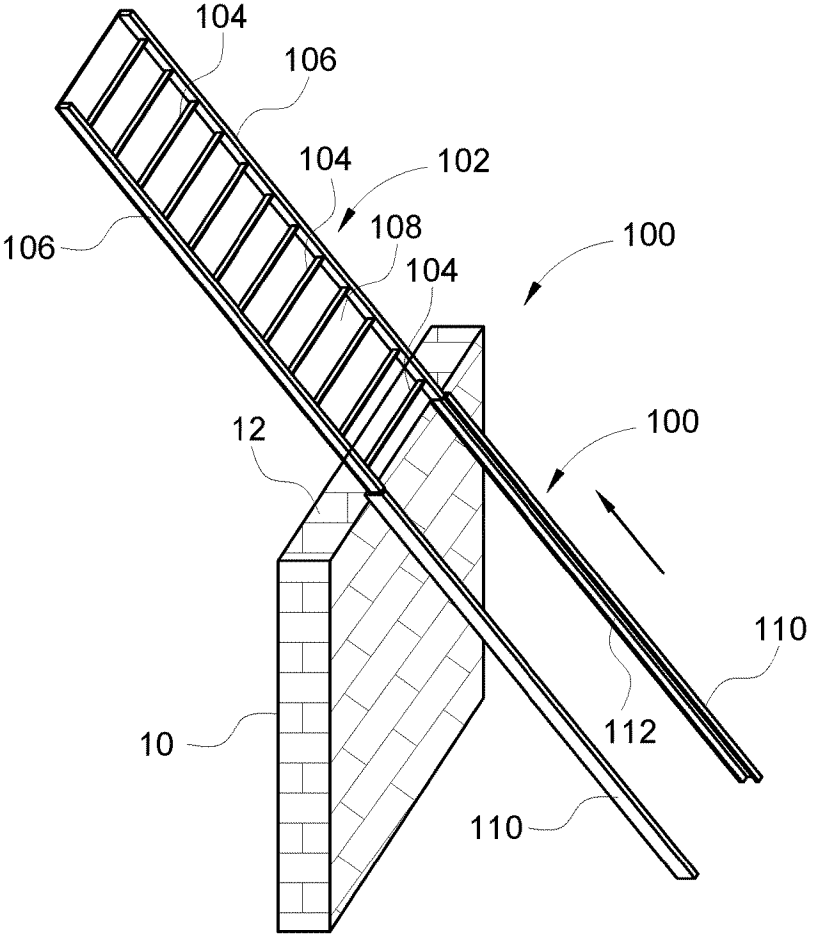
FIG. 2 illustrates a diagrammatic perspective view of the safety pool ladder 100 being slid upwards with respect to the above-ground pool 10, in accordance with one or more embodiments of the present invention.

In an embodiment of the present disclosure, the ladder structure 102 is adapted to slide between and along the length of the side rails 110 in the channels 112 thereof. In particular, as depicted in FIG. 2, the ladder structure 102 can move along the length of the side rails 110 (as indicated by an arrow) such that the lower end thereof may travel up to the top 12 of the wall 10. This allows the ladder structure 102 to be lifted completely off of the ground and thus make the safety pool ladder 100 inaccessible for ingress into the pool 10. It may be understood that the ladder structure 102 may be pushed by a user, or may have automatic motive means, to provide sliding movement thereto. In some examples, the side rails 110 may be provided with ball bearings (not shown) or the like arranged in the channels 112 of the side rails 110 to provide smoother movement of the ladder structure 102 when travelling along the side rails 110.

Figure 3:
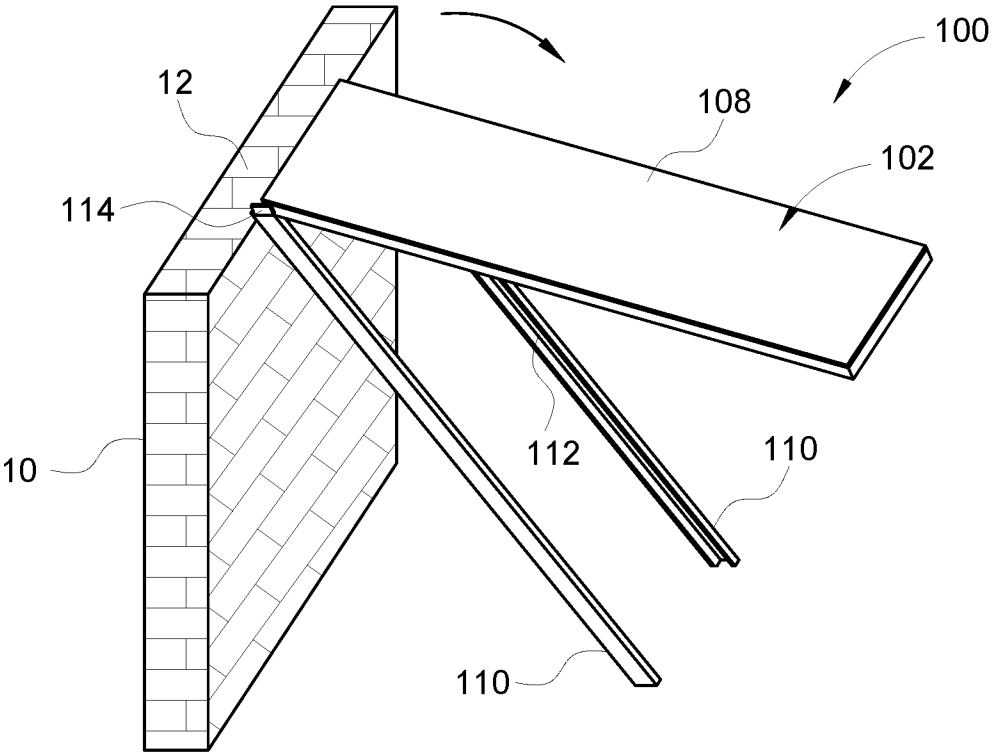
FIG. 3 illustrates a diagrammatic perspective view of the safety pool ladder 100 being flipped after being slid upwards, in accordance with one or more embodiments of the present invention.

Further, in an embodiment of the present disclosure, the ladder structure 102 is adapted to rotate about lower edges thereof when reached to top edges of the side rails 110, i.e. at the top 12 of the wall 10. In particular, as depicted in FIG. 3, the ladder structure 102 is rotated to fall back or flip about the lower edges thereof (as indicated by an arrow). As may be seen, when rotated, the flat surface 108 is flipped to be disposed towards front side and the step members 104 are now disposed towards back side of the ladder structure 102, in the safety pool ladder 100. In particular, the ladder structure 102 may include a rotational joint 114, such as a roller bearing or the like, arranged at the top edge of the side rails 110, such that the rotational joint 114 may provide free rotation of the ladder structure 102 about top edges thereof at the top edge of the side rails 110.

Figure 4:
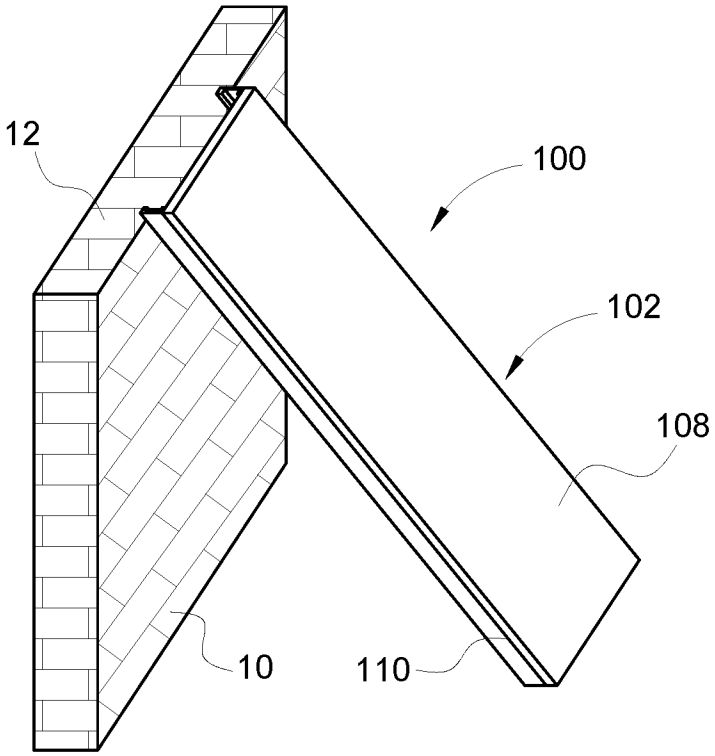
FIG. 4 illustrates a diagrammatic perspective view of the safety pool ladder 100 disposed against the above-ground pool 10 in a block position, in accordance with one or more embodiments of the present invention.

FIG. 4 illustrates the safety pool ladder 100 of the present disclosure being disposed in the block position. When the flipped ladder structure 102 (from FIG. 3) falls off and is supported on the side rails 110, the block position configuration of the safety pool ladder 100 is obtained. In the block position configuration, the ladder structure 102 is disposed such that the flat surface 108 is now arranged towards the front in the safety pool ladder 100 in relation to the wall 10. It may be appreciated that the block position configuration with the flat surface 108 in front does not provide any means for children or unauthorized persons to climb on to the top 12 of the wall 10, via use of the ladder structure 102. Thereby, the safety pool ladder 100 can prevent ingress to the pool 10 therefrom, and thus provide a simple and expeditious means for rendering the pool absolutely safe, insofar as small children are concerned.

In some embodiments, the safety pool ladder 100 further includes locking means (not shown) for locking the flipped ladder structure 102 substantially in the block position. When the locking means are engaged, the sliding or rotation of the ladder structure 102 can be prevented. It may be appreciated that the ladder structure 102 is first unlocked to be moved back to the use position for providing ingress to the pool 10, and may be subsequently locked for preventing inadvertent sliding of the ladder structure 102 along the side rails 110.

As discussed, the safety pool ladder 100 of the present disclosure can be implemented for an above-the-ground swimming pool 10. The safety pool ladder 100 having the pivotal ladder structure 102 that may be conveniently and easily swung up off the ground out of the reach of small children, and then flipped to provide a flat surface 108 can be utilized to prevent ingress into the pool 10, for example when the pool 10 is left unattended for a comparatively short periods of time. In some examples, the ladder structure 102 may also be completely detached without the use of tools and stored in a place distant from the pool 10, for example when the pool 10 is left unattended for comparatively long periods of time.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A safety pool ladder installed against a wall of an above-ground pool and adapted to be moved between a use position for providing ingress into the above-ground pool and a block position to prevent ingress into the above-ground pool, the safety pool ladder comprising:

a ladder structure comprising a plurality of step members and a pair of side members, wherein the plurality of step members extends horizontally between the pair of side members, and a flat surface disposed towards back of the plurality of step members, when the safety pool ladder is disposed in the use position; and a pair of side rails with channels formed therein such that the pair of side members of the ladder structure is movingly arranged in the channels to allow the ladder structure to travel along a length of the side rails, wherein the ladder structure is adapted to travel along the length of the side rails, and rotated and flipped thereafter such that the flat surface is disposed towards front of the plurality of step members to dispose the safety pool ladder in the block position.

2. The safety pool ladder of claim 1, wherein the channels are U-shaped channels.

3. The safety pool ladder of claim 1, wherein the ladder structure comprises a rotational joint to allow for rotation thereof.

4. The safety pool ladder of claim 1, wherein the ladder structure is made of aluminum.

5. The safety pool ladder of claim 1, wherein the pair of side rails are made of aluminum.

* * * * *